US005308084A

United States Patent [19]

Morrell

[11] Patent Number: 5,308,084

[45] Date of Patent: May 3, 1994

[54] THREE-DIMENSIONAL ARCHERY TARGET

[76] Inventor: Dale A. Morrell, Rte. 2, Box 699, Alma, Ark. 72921

[21] Appl. No.: 24,395

[22] Filed: Mar. 1, 1993

[51] Int. Cl.[5] ..... F41J 3/00

[52] U.S. Cl. ..... 273/403; 273/408

[58] Field of Search ..... 273/403, 404, 407, 408

[56] References Cited

U.S. PATENT DOCUMENTS

| | | | |
|---|---|---|---|
| 2,812,947 | 11/1957 | Fatzinger | 273/404 |
| 3,586,331 | 6/1971 | Tickell, Jr. | 273/372 |
| 4,054,288 | 10/1977 | Perrine, Sr. | 273/407 |
| 4,203,600 | 5/1980 | Brown | 273/407 |
| 4,477,082 | 10/1984 | McKenzie et al. | 273/403 |
| 4,565,376 | 1/1986 | Croll | 273/408 |
| 4,630,832 | 12/1986 | Swanson | 273/374 |
| 4,643,434 | 2/1987 | Carlin | 273/408 |
| 4,850,596 | 7/1989 | Olund | 273/408 |
| 5,002,285 | 3/1991 | Morrell | 273/408 |

*Primary Examiner*—William H. Grieb
*Attorney, Agent, or Firm*—Daniel R. Alexander

[57] ABSTRACT

A three-dimensional life-size game animal-simulating archery target including a foam body shaped in the form of a game animal, such as a deer, elk, moose, bear, wild boar, etc., and having a target insert receiving recess located in a primary aiming point of the target. A removable target insert adapted for use with broad head arrows, field point arrows, or both, is releasably secured in the recess in the foam body, and a removable body cover placed over the insert and recess to provide a uniform visual appearance to the exterior of the game animal. A three-dimensional game animal archery target system includes a foam body shaped in the form of a game animal together with at least two removable target inserts, one being adapted for use with broad head arrows and the other being adapted for use with target point or field point arrows. Such a system provides the user with the ability to utilize the same target for archery target practice and hunting preparation with both field point and broad head arrows. The removable target insert is a substantially cylindrical, elongate item sized so as to be received within and substantially fill the recess in the foam body and is constructed of either foam for use with broad head arrows or burlap sacks filled with packing material and having a penetration resistant central core for use with field point and target point arrows.

27 Claims, 3 Drawing Sheets

THREE-DIMENSIONAL ARCHERY TARGET

BACKGROUND OF THE INVENTION

The present invention is directed to archery targets, and, more particularly, concerns a life-size three-dimensional animal-simulating archery target having an animal-shaped body, a replaceable target insert, and a replaceable body cover. The archery target is adapted for use with both broad head and field point arrows, and, since the target simulates a game animal, it provides not only for target practice but also provides an experience closely related to actual bow hunting of game animals.

Conventional three-dimensional life-size animal-simulating archery targets having the target formed from a single piece of molded foam having a shape resembling that of a game animal, for example a deer, suffer from several drawbacks. First, the primary target area located in the kill area or vital area of the upper chest cavity is the primary aiming point and relatively quickly destroyed due to repeated strikes with arrows and the entire target must be replaced. Replacement of the entire foam target involves a substantial expenditure, especially when relatively large targets are concerned. This problem is accentuated when broad head arrows are used for target practice.

Another drawback related to the use of the single piece three-dimensional animal-simulating archery target is the selection of the weight of foam used for target construction. The entire target must be constructed of a relatively dense, heavy and expensive foam material, such as 5 or 6 lbs/cu/ft polyurethane foam. Further, the foam selected to construct the entire target must be adapted for use with both broad head and field point arrows. If the foam material is not dense enough, the arrows which strike the target may completely penetrate therethrough or penetrate so far that the feathers on the rear of the arrow are entangled in the foam material causing costly arrow damage.

One attempt at addressing some of the above-described drawbacks of the single piece foam target is described in U.S. Pat. No. 4,477,082 issued to McKenzie et al. and entitled "Archery Target With Replaceable Target Segments". The archery target is disclosed as having first and second body segments having a shape simulating the forward and rearward extremities respectively of an animal and a replaceable central target segment having a shape corresponding to the central trunk of the animal. The central replaceable target segment is releasably joined to the forward and rearward body segments by vertical male and female dovetails. The target was intended to reduce the costs involved with the use of three-dimensional foam archery targets by having a replaceable target segment which is removed and replaced following extended use of the target, while the forward and rearward body segments are reused together with a new target segment. However, since the replaceable target segment comprises approximately one-third of the total target area, it is relatively expensive to replace. Further, during actual use of such a target, the vertical dovetails holding the segments together tend to come apart with repeated arrow strikes due to the dynamic force of the arrows impacting the target. In an attempt to keep the target together, one may add cement, glue, or foam adhesive between the target segments, but, in so doing, they destroy the replaceability of the central target segment. Once this is done, following extended use and disintegration of the target segment, the entire target has to be replaced.

U.S. Pat. No. 4,565,376, issued to Croll, and entitled "Animal-Simulating Three-Dimensional Archery Target and Method of Manufacture" discloses an archery target wherein transversely gathered thermoplastic film is wrapped into the shape of an animal and the wrapped shape is covered with thermoplastic sheeting heat-sealed to the wrapped film. The shape is filled with additional transversely gathered plastic film folded upon itself and inserted into the wrapped film shape. The plastic film material has a self-closing or healing characteristic intended to permit the target to resist destruction and increase the service life of the target. Such a material is not suitable for use with broad head arrows because the plastic material will close in around the back of the arrowhead making it difficult to remove.

Hence, there is a need for an improved three-dimensional life-size animal-similating archery target which is adapted for use with both broad head and field point arrows, which does not come apart during use, and which provides for a relatively long service life at reduced cost.

SUMMARY OF THE INVENTION

In accordance with the present invention, a three-dimensional life-size animal-simulating archery target is provided which includes an animal-shaped foam body and a removable target insert adapted for placement in an insert retaining recess in the animal body and serving as the primary aiming point and arrow receiving component of the archery target.

In accordance with the preferred embodiment of the present invention, the three-dimensional life-size animal-like archery target includes a foam body shaped in the form of a game animal and composed of molded front and rear sections joined together in the belly area of the animal. Further, the target includes a target insert received within a target insert receiving recess in the back of the animal between the front and rear shoulders thereof. Further, the archery target includes a body cover or jacket adapted to cover the target insert and receiving recess so as to provide a uniform appearance to the exterior of the animal. The body cover may include a bull's eye or scoring rings providing a primary aiming point during target practice and being located over the central area of the target insert.

The body cover and target insert are relatively inexpensive and easily removed and replaced following extended use while the foam animal-shaped body is retained for further use with a new target insert and body cover. Thus, the archery target of the present invention provides a relatively low cost archery practice system since the foam animal-shaped body can be used over and over through many seasons or tournaments while the relatively inexpensive target inserts and body covers are replaced as necessary.

In accordance with another aspect of the present invention, a three-dimensional life-size animal-like archery target system adapted for use with both broad head and field point arrows includes a foam animal-shaped body having a target insert receiving recess located in a kill area or primary aiming point of the animal, and at least two different target inserts, one being adapted for use with broad head arrows and the other being adapted for use with field point or target head arrows.

In accordance with an exemplary embodiment, the target insert adapted for use with broad head arrows is made up of a substantially cylindrical elongate section of polyurethane foam having embedded therein a block of penetration resistant ethafoam. Also, in accordance with an exemplary embodiment, the target insert adapted for use with field point or target head arrows is a substantially cylindrical elongate fabric covered item having a free floating central core formed by a plurality of stacked sheets of a penetration resistant material surrounded by compressed packing material. The central core and compressed packing material are enclosed by a moisture barrier which itself is wrapped with a plurality of layers of a mesh material having openings dimensioned so as to freely pass an arrow tip, and an outer fabric cover surrounding the mesh material. In accordance with a preferred embodiment the free floating central core is formed by a plurality of stacked sheets of woven burlap fabric, the compressed packing material is cotton molt, the moisture barrier is a polyethylene bag, the mesh material is nylon mesh having openings at least one-fourth of an inch in diameter, and the fabric cover is burlap fabric. Such a target insert has a long service life and allows arrows to be easily removed. Once arrows strike the target insert, they are maintained in an orientation perpendicular to the front face of the insert, minimizing their exposure to subsequent arrows, and thus preventing expensive arrow damage.

In order to prevent arrows from passing through the archery target between the base of the insert receiving recess and the lower edge of the target insert, a rectangular ethafoam block is added along the center line of the recess and thereby sandwiched between the foam body and the target insert.

The principal object of the present invention is the provision of a three-dimensional animal simulating archery target having a replaceable target insert located in the primary aiming point of the archery target.

Another object of the present invention is the provision of a three-dimensional archery target system which is adapted for use with both broad head and field point arrows.

A still further object of the present invention is the provision of a target insert adapted for use with a three-dimensional life-size animal-simulating archery target having an insert receiving recess located in a kill zone of the animal.

Still yet another object of the present invention is the provision of a three-dimensional archery target including a foam animal-shaped body, a removable target insert, and a removable body cover.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENTS

Figure 1:
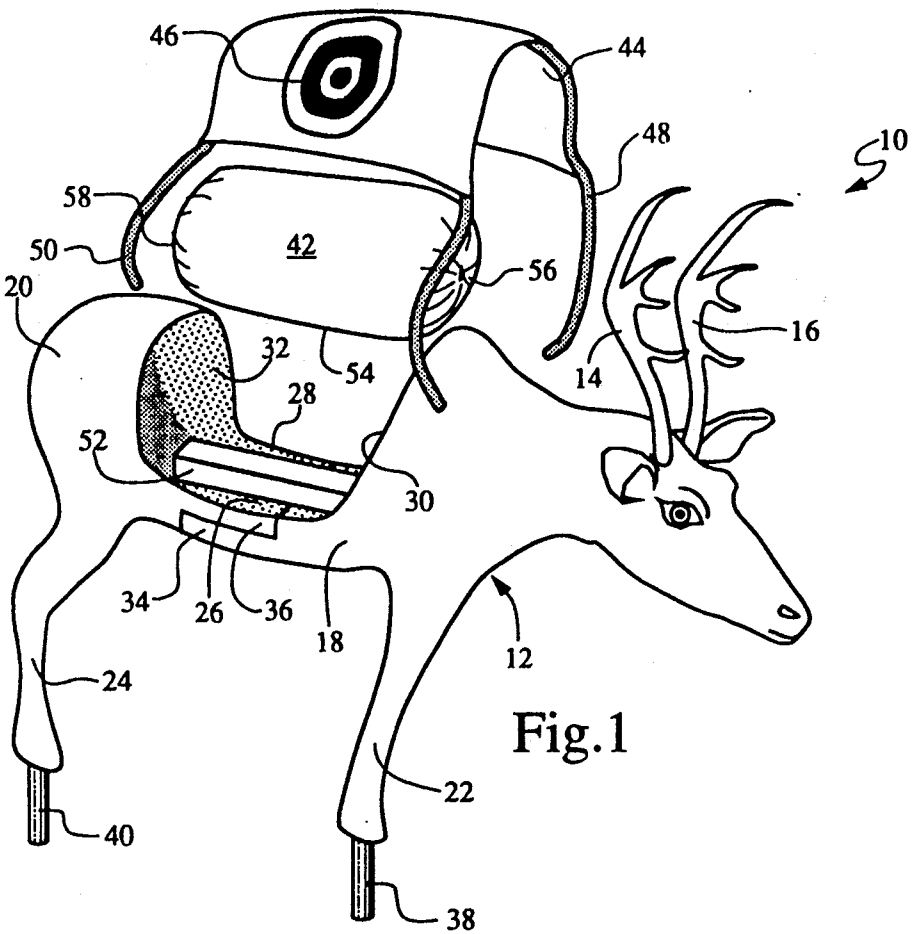
FIG. 1 is an exploded perspective view representation of the three-dimensional archery target in accordance with one embodiment of the present invention.

In accordance with an exemplary embodiment of the present invention as shown in FIG. 1 of the drawings, a three-dimensional life-size animal-simulating archery target is generally designated by the reference numeral 10 and shown to include a foam body 12 having a deer-like shape and including removable antlers 14 and 16, and front and rear body sections 18 and 20 each having respective front and rear legs 22 and 24. The foam body 12 further includes a target insert receiving recess 26 made up of a large opening or cutout 28 in the back of the animal and front and rear cavities 30 and 32. The foam body 12 is constructed of molded polyurethane foam having a density of from two to nine lbs/cu/ft, preferably six lbs/cu/ft. The front and rear body sections 18 and 20 of foam body 12 have overlapping and interfitting flanges 34 and 36 which are joined together in the belly area of the animal. A section of steel pipe or conduit 38 and 40 is molded into the base of each of the legs 22 and 24 to provide for the mounting of the archery target 10 in an upright operative position for use, for example, over metal stakes that are driven into the ground.

The three-dimensional archery target 10 further includes an elongate, substantially cylindrical target insert 42 adapted to be received in and substantially fill the insert receiving recess 26 of foam body 12. The target further includes a body cover 44 for covering the target insert 42 and recess 26 so as to provide a uniform appearance to the exterior of the game animal. The body cover 44 includes a bull's eye or scoring rings 46 on the exterior thereof to indicate the primary aiming point for arrows directed at the target 10. The bull's eye 46 is preferably located on the exterior of the body cover positioned to overlie the central region of the target insert 42 when the insert is located in an operative position within the insert receiving recess 26 and the body cover is secured to the exterior of the foam body 12. The body cover 44 includes front and rear draw strings 48 and 50 for securing the body cover to the foam body 12.

Figure 7:
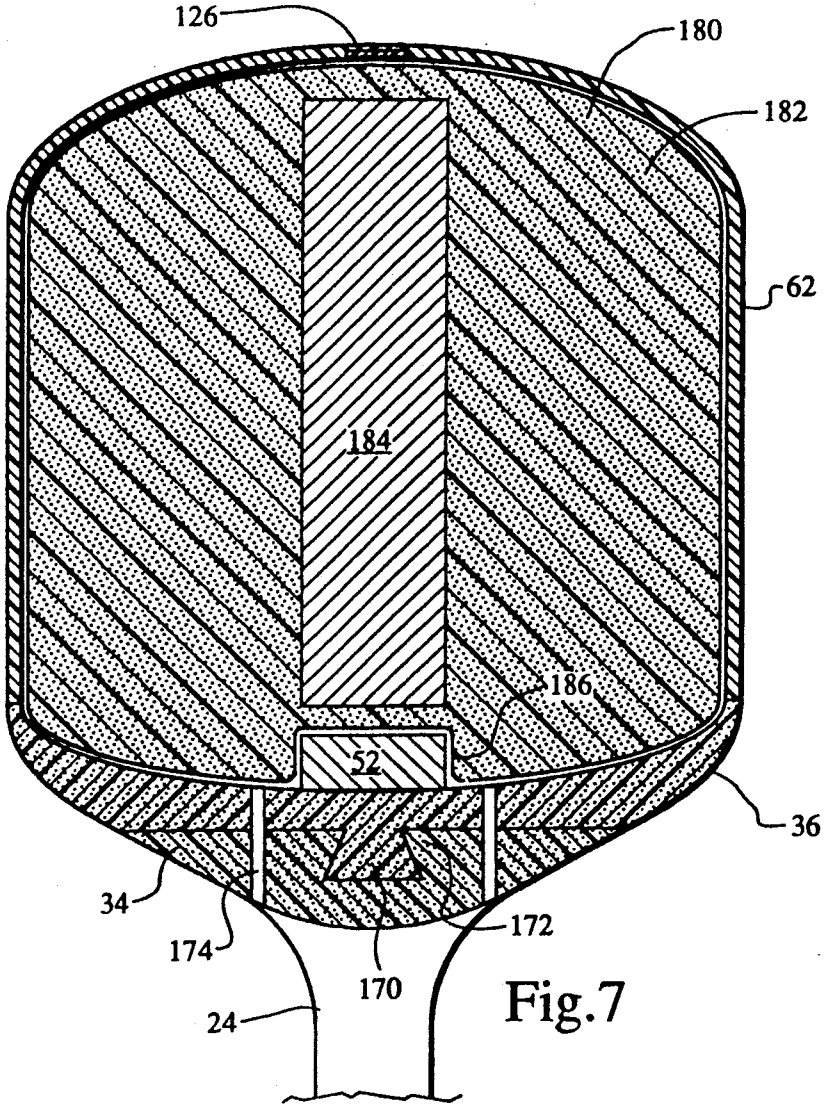
FIG. 7 is a cross section representation taken along line 7—7 in FIG. 2 and having a target insert adapted for use with broad head arrows.
Figure 6:
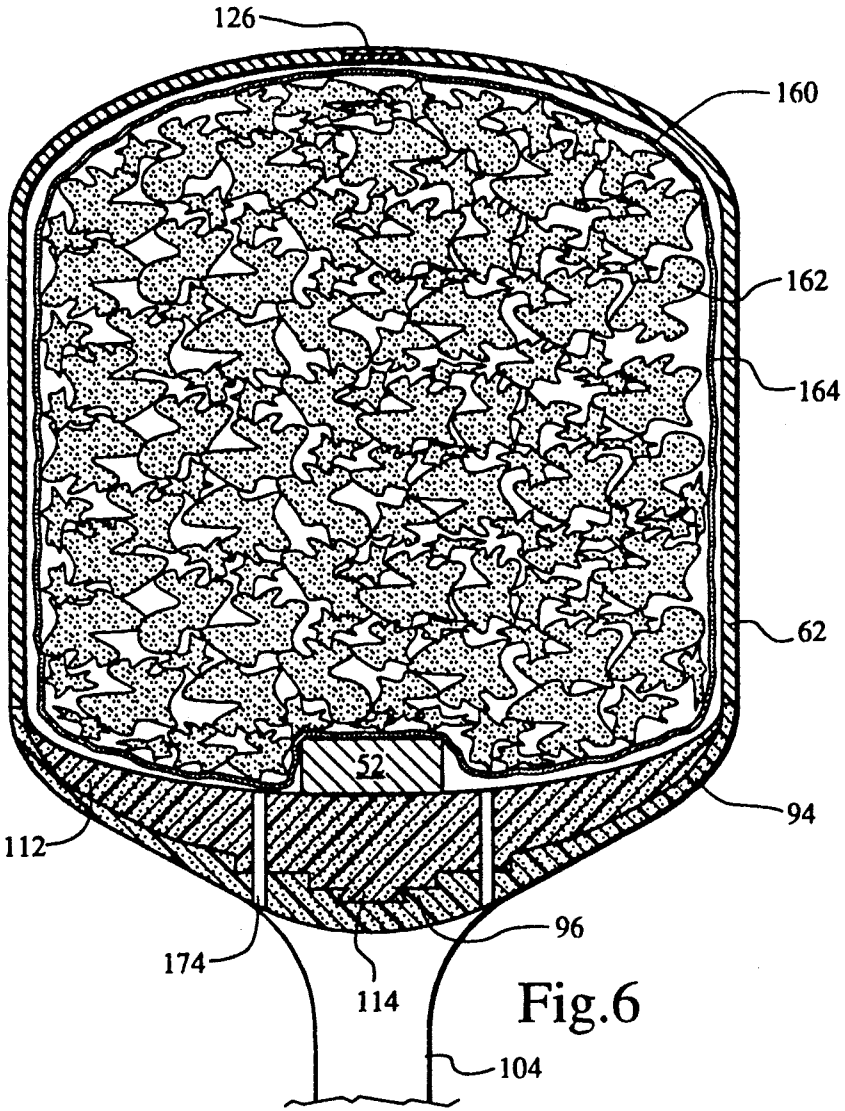
FIG. 6 is a cross section illustration taken along lines 6—6 in FIG. 3.

Although it is not required, it is preferred that an elongate rectangular foam block 52, for example two to nine lbs/cu/ft ethafoam, preferably six lbs/cu/ft ethafoam, be attached to the base of the recess 26 so as to extend along the center line or long axis of the recess and, as such, be sandwiched between the recess and lower surface 54 of the target insert 42 (FIGS. 6 and 7). This foam block 52 is designed to prevent arrows from passing through the archery target 10 between the recess 26 and lower surface 54 of the target insert 42. The arrow penetration prevention element or block 52 may be attached to the foam body 12 by an adhesive adapted for use with urethane foams, or by being molded into one of the front and rear body sections 18 and 20 during formation thereof.

It is preferred that the elongate rectangular block 52 be formed of six to nine lbs/cu/ft ethafoam and is molded into one of the front or rear body sections. Alternatively, the block 52 can be constructed of two sections with the forward section being molded into the front body section of the foam body and the rearward section being molded into the rear body section of the foam body during the molding process used to produce the foam body sections.

Figure 4:
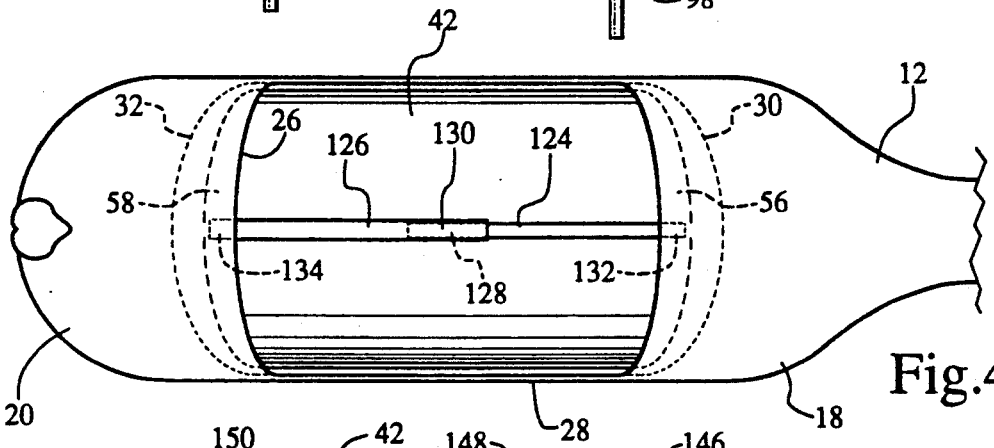
FIG. 4 is a top plan view illustration of the three-dimensional archery target of FIG. 2 with the body cover removed.

The target insert 42 has front and rear ends 56 and 58 which extend within the respective front and rear cavities 30 and 32 in the foam body 12 when the target insert 42 is placed in an operative position in the recess 26 (FIG. 4).

In the embodiment shown in FIG. 1 of the drawings, the body cover 44 is preferably formed of a fabric material, such as burlap, and the exterior surface of the foam body 12 is textured so that the body cover 44 and foam body 12 have a uniform exterior appearance which is lifelike in that it resembles the fur of a deer or game animal.

In accordance with one embodiment of the present invention, the head of foam body 12 includes antler receiving recesses for receiving the lower end of each of the removable antlers 14 and 16. However, it is contemplated that removable antlers 14 and 16 may be attached to the foam body 12 in an alternative manner, such as having a sharp point or a short length of wire extending from the base of each of the antlers and being adapted for being struck into the head of foam body 12, or having respective lengths of wire being molded into the head of the foam body 12 and adapted for receiving the base of each of the removable antlers 14 and 16. It is preferred that the antlers 14 and 16 be formed of two to six pound polyurethane foam.

It is to be understood that the archery target 10 shown in FIG. 1 resembles a deer-like animal, such as a buck or antlered deer, and that the antlers may be removed so as to provide the appearance of a doe or antlerless deer. Although the foam body 12 is shown to be in the shape of a deer-like animal, it is to be understood that the archery target of the present invention is suited for use with a variety of foam bodies shaped to resemble game animals such as deer, antelope, bear, elk, moose, wolf, cougar, etc.

Although it is preferred that the foam body 12 include a head, front and rear shoulders, and front and rear legs, it is contemplated that the foam body could incorporate four legs with at least two of the legs providing for support of the three-dimensional archery target.

Figure 2:
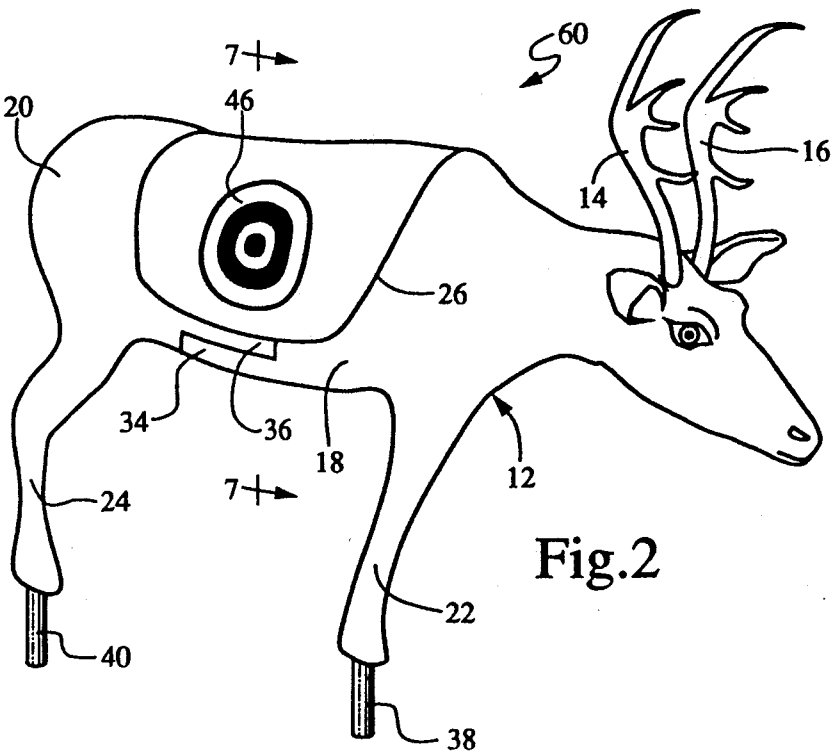
FIG. 2 is a perspective view illustration of an assembled and ready-to-use archery target in accordance with another embodiment of the present invention.

In accordance with another embodiment of the present invention and as shown in FIG. 2 of the drawings, a fully assembled and ready-to-use three-dimensional life-size animal-like archery target is generally designated by the reference numeral 60 and shown to include the same foam body 12 as the archery target 10 of FIG. 1 with the exception of straps 124 and 126 (FIG. 4). Target 60 includes a body cover 62 which differs from the fabric body cover 44 of FIG. 1 by being formed of molded polyurethane or cardboard and shaped so as to fit within the recess 26 with the exterior surface of the body cover in line with the exterior surface of the foam animal body 12 to provide a continuous outer surface to the archery target 60. The exterior surface of the body cover 62 and the exterior surface of the foam body 12 may be similarly textured so as to provide a lifelike and uniform appearance to the animal. For example, the exterior surfaces may be textured so as to resemble fur of an animal. The body cover 62 may include a bull's eye or scoring rings 46 the same as those of the body cover 44 of archery target 10 (FIG. 1).

Although it is preferred to use a body cover in conjunction with the foam animal body and target insert to provide a uniform appearance to the exterior surface of the archery target, it is contemplated that one could utilize the archery target without the body cover. The body covers 44 of FIG. 1 and 62 of FIG. 2 are removable and replaceable and formed of a material which allows for the penetration of arrows therethrough. In the shown embodiments, the body covers are made of either a fabric material such as ten ounce woven burlap or a relatively thin layer of polyurethane foam. For example, a one inch thick layer of molded polyurethane foam in the form of an inverted U and having an exterior edge which mates with the exterior edge of the insert receiving recess. As such, body covers 44 and 62 are made of relatively inexpensive materials which can withstand repeated strikes by arrows without disintegrating or falling apart.

Although it is preferred that the foam body 12 be releasably assembled, that is front and rear sections 18 and 20 be attached one to the other in a manner allowing for disassembly of the foam body 12 (dovetailed flanges, threaded fasteners, or nuts and bolts) and thereby facilitating shipping, transport and movement of the archery target from one location to another, it is contemplated that one may assemble the front and rear body sections 18 and 20 together in a permanent fashion, for example using solvents, or cement adapted for use with a urethane foam, or that instead the foam body 12 be molded as a unitary item wherein the front and rear body sections are both part of a single piece animal-shaped foam body.

Figure 3:
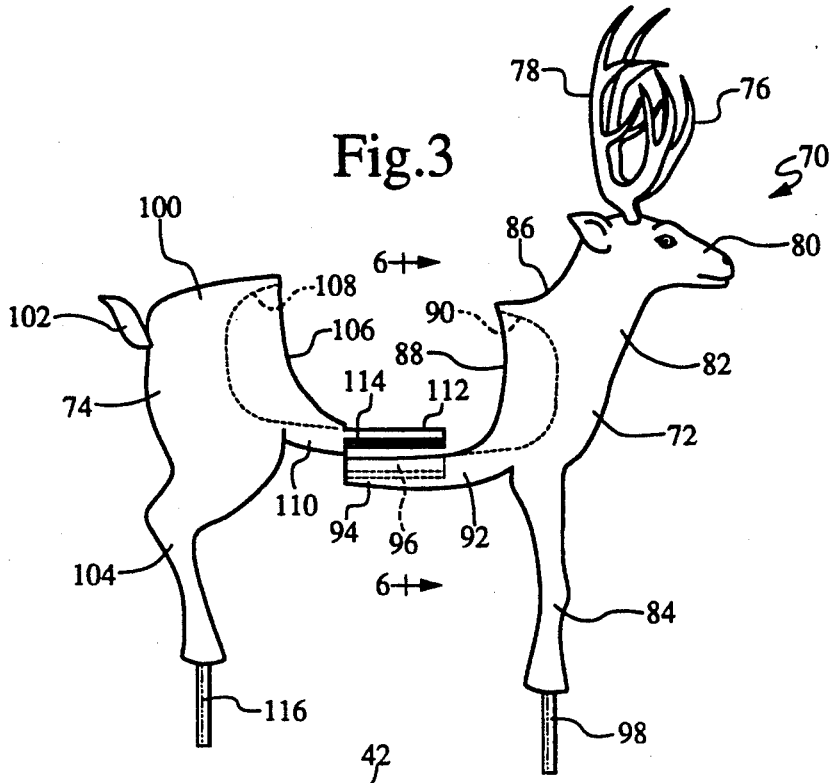
FIG. 3 is an exploded side view representation of the foam animal-simulating body in accordance with yet another embodiment of the present invention.

With reference to FIG. 3 of the drawings, an exemplary foam body generally designated 70 is shown to include front and rear body sections 72 and 74 and removable antlers 76 and 78. Front body section 72 includes a head 80, neck 82, front leg 84, front shoulder 86, front half 88 of an insert receiving recess, a front cavity 90, a front belly portion 92, a flange 94, and male dovetail element 96. A short section of metal pipe or conduit 98 is molded into the base of front leg 84. Rear body section 74 includes rear shoulder or hindquarters 100, a tail 102, rear leg 104, and a rear half 106 of the insert receiving recess, a rear cavity 108, a rear belly portion 110, a flange 112 and a female dovetail element 114. A short section of pipe or conduit 116 is molded into the base of rear leg 104. The removable antlers 76 and 78 are preferably molded from polyurethane foam and either molded to have sharp pointed lower ends which are stuck down into the head 80 or are molded so as to have wire sticking out of the lower ends thereof which can be stuck into and, as such, attached to the head 80.

In the embodiment shown in FIG. 3 of the drawings, the foam body 72 is shaped so as to represent a deer-like or antelope-like game animal and is formed of front and rear body sections 72 and 74 which are joined one to the other by placing the end of flange 94 adjacent the end of the flange 112 and aligning the male and female dovetail elements 96 and 114 and then sliding one relative to the other so as to cause the female dovetail element to telescopically receive the male dovetail element and thereby join the front and rear sections 72 and 74 to form a unitary foam body 70 (FIG. 6). Using a horizontal dovetail arrangement to join the front and rear body sections 72 and 74 allows for the later disassembly of the foam body 70 when it is desired to move the archery target from one location to another or to transport the target in, for example, a small trunk of an automobile. Also, by separating the front and rear body sections 72 and 74, it is possible to reduce the weight of the individual components which need to be carried or transferred from one location to another. The horizontal dovetail arrangement 96 and 114, in combination with the vertical mounting elements 98 and 116 adapted to telescopically receive the upper end of elongate metal stakes driven into the ground, provide for a structurally stable assembled foam body which will not come apart during use of the archery target.

As illustrated in FIG. 4 of the drawings, the three-dimensional archery target 60 is shown with body cover 62 removed so as to provide a view of the target insert 42 within the insert receiving recess 26 and of a releasable target insert securing arrangement made up of straps 124 and 126 having respective overlapping ends 128 and 130 with at least a portion of the overlapping ends 128 and 130 having respective hook and eye elements. When the hook and eye elements of strap ends 128 and 130 are brought into contact with each other and pressed together, the straps 124 and 126 are releasably secured one to another. Opposite the ends 128 and 130, ends 132 and 134 of straps 124 and 126 are secured to the respective front and rear body sections 18 and 20 of the foam body 12 by having the ends 132 and 134 molded into the foam body sections. It is preferred that the insert securing straps 124 and 126 be secured to the front and rear body sections 18 and 20 by placing knots in the respective ends of the straps and molding the knotted ends into the body sections during the molding process for producing the front and rear body sections.

As shown with hidden lines in FIG. 4 of the drawings, the target insert 42 has a length or longitudinal dimension which is less than the overall length of recess 26 including cavities 30 and 32, but which is greater than the length of the central cutout or opening 28 of the insert receiving recess 26. As such, the ends 56 and 58 of the target insert 42 extend into the recesses 30 and 32 in the front and rear body sections 18 and 20. The target insert 42 is removed from the foam body 12 for either disassembly of the archery target 60 or to replace a worn target insert 42 with a new target insert by first pulling the ends 128 and 130 of the straps 124 and 126 apart thereby undoing or releasing the hook and eye portions, then sliding the target insert 42 toward the rear of the foam body so that the end 58 abuts with the surface of concave cavity 32. With the end 58 against the wall of cavity 32, the end 56 of the target insert 42 can be lifted up and out of the opening 28 of recess 26. Straps 124 and 126 are formed of a flexible material, such as nylon or cotton, and, as such, allow the target insert to pass thereby by bending or flexing out of the way of the insert.

To place an insert 42 within the recess 26 the above-described process is reversed in that straps 124 and 126 are flexed out of the way of opening 28, the end 58 of the insert 42 is dropped down into the opening 28 and stuffed back into the cavity 32 so that the end surface of the insert is in contact with the cavity wall, the front end 56 of the insert 42 is dropped down through the opening 28 and then the insert 42 is shifted forward so that both ends 56 and 58 are received within their respective cavities 30 and 32 of the foam body 12. Thereafter, ends 128 and 130 of straps 124 and 126 are brought into contact with one another and pressed together so as to form an attachment between the hook and eye elements on the straps.

Alternatively, the target insert 42 can be removed or replaced by disassembling the foam body 12 (separating the front and rear body sections), pulling out the old target insert, placing a new target insert between the body sections, and then assembling the foam body (joining the front and rear body sections).

It is preferred that once the target insert 42 has been placed and secured within the insert receiving recess 26 that the body cover 62 be placed over the cutout 28 and pushed down against foam body 12 with the side edges of the body cover 62 abutting and mating with the outer edges of recess 26 (FIG. 2). Although a body cover is not required for the archery target to be functional (a bull's eye or scoring rings could be painted or printed on the side of target insert 42), it is preferred that a body cover (body cover 62 of FIG. 2 or body cover 44 of FIG. 1) be added to provide a uniform and lifelike appearance to the game animal.

Figure 5:
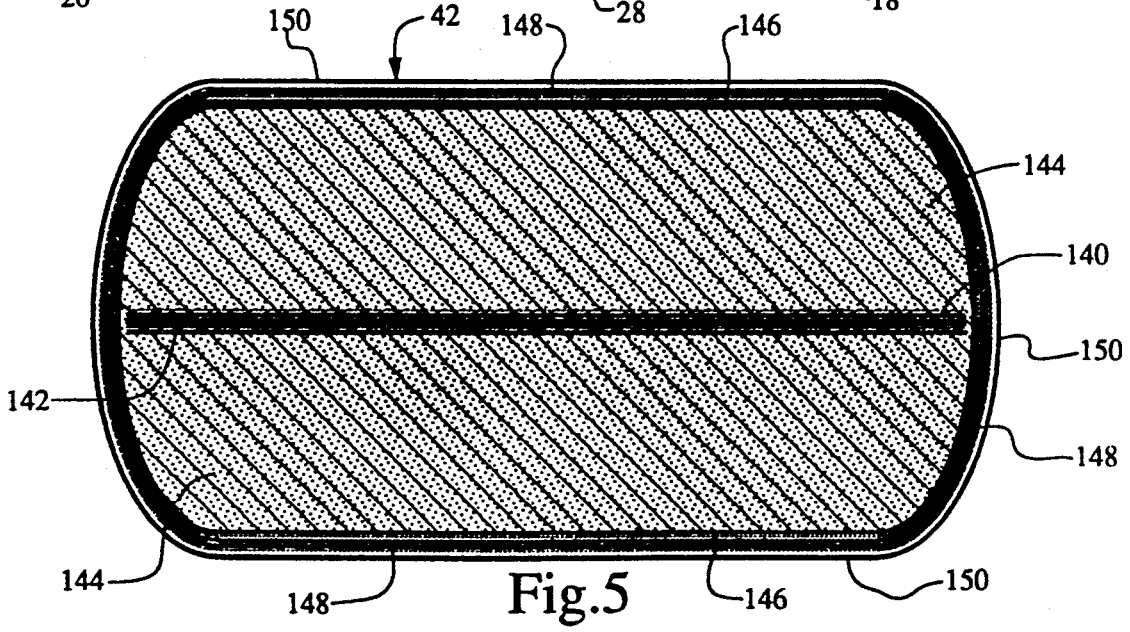
FIG. 5 is a longitudinal cross section representation through a target insert having a free floating central core.

In accordance with a preferred embodiment of the present invention as shown in FIG. 5 of the drawings, the target insert 42 adapted for use with field point or target head arrows includes a free floating central core 140 made up of a plurality of stacked sheets of a penetration resistant material, such as twenty ounce woven burlap fabric or woven nylon material, with each of the sheets aligned along a common plane intended to be arranged in a vertical orientation within the archery target. FIG. 5 represents a horizontal or longitudinal cross section of the target insert 42 as shown in either FIGS. 1 or 4 of the drawings. The central core 140 is surrounded by compressed packing material 144, such as cotton molt. The compressed or tightly packed material 144 is contained within a moisture barrier such as a three mil polyethylene bag. The moisture barrier 146 is wrapped with a plurality of layers of mesh material, such as nylon mesh, having openings dimensioned to freely pass an arrow tip. For example, the nylon mesh 146 has openings greater than one-quarter by one-quarter of an inch, so that penetrating arrows are unlikely to hit and break the strands of the mesh. The mesh material 146 is covered by one or more layers of fabric material 148, such as ten ounce woven burlap fabric. Such a target insert 42 has a long service life and allows arrows to be easily removed. Once the arrow strikes the target insert, it is maintained in an orientation perpendicular to the front face of the target insert minimizing its exposure to subsequent arrows and thus preventing expensive arrow damage. The free floating central core 140 is oriented parallel to the front and back faces of the target insert and serves to absorb arrow impact without being penetrated. This further prevents expensive arrow damage.

In accordance with an exemplary embodiment of the target insert, the central core 140 is formed of eight sheets 142 of twenty ounce burlap folded over at their upper ends so as to form sixteen layers. The burlap fabric is available from Katy Bag Company of Pearson, Ga. The packing material 144 is preferably a compressed cotton molt having less than one and one-fourth inch strands of the type available from Smith Cotton Company of Blytheville, Ark. The moisture barrier 146 is preferably a three mil polyethylene bag of a type available from Ace Bag Company from Newark, N.J. The mesh material or netting 148 is preferably wrapped around the sides of the insert at least twenty times and around the ends at least six times and is a nylon mesh having openings five-eighths by three-fourths of an inch. Such mesh is available from Internet, Inc. of Minneapolis, Minn. The outer covering 150 is preferably two layers of a coarse weave fabric material such as ten ounce burlap bags sealed at their openings by staples or hog rings. Suitable burlap bags are available from Katy Bag Company of Pearson, Ga.

A less expensive version of a target insert 160 adapted for field point or target head arrows is shown in FIG. 6 of the drawings to include a compressed packing material 162 such as rags, cloth pieces, burlap bags, fabric scraps, cotton molt or the like packed into a substantially cylindrical outer cover or case 164 formed of a fabric material such as two layers of a coarse weave fabric material, for example two ten ounce burlap bags sealed at their openings by staples, hog rings or by sewing with heavy duty thread or light cord.

Typically, burlap bags include a seam along one side. In accordance with a preferred embodiment, this seam of the burlap bags forming the outer cover 150 of target insert 42 is aligned with the top edge of the stacked sheets 142 of the central core 140. Thus, the side seam on the outer burlap bag 150 provides an indication of the top of the target insert which should be aligned so as to be located directly beneath the straps 124 and 126 (FIG. 4) when the target insert 42 is inserted into the target receiving recess 26 of the foam body 12. Thus, it is possible to insure that the free floating central core 140 is oriented vertically within the three dimensional archery target and will serve its intended purpose of absorbing the impact and resisting penetration of arrows which strike the target insert.

Since the target insert 42 is represented in FIG. 5 as being symmetrical in that it contains packing material 144 on both the front and rear sides of the central core 140, the target insert may be used to receive arrows directed at the archery target from either side of the game animal or, instead, if the target is only used for target practice from one side of the animal, the target insert may be rotated through 180° or may be removed from the target and reinserted with the opposite end (end 56 in cavity 32 instead of cavity 30) so that a worn side of the target insert may be exchanged for a fresh side, thus doubling the useful life of the insert.

Inasmuch as the three-dimensional archery target of the present invention is adapted for use in archery target practice from either side and, as such, may include a bull's eye or scoring ring on both sides of the body cover, the useful life of the target is approximately doubled since the target may be rotated through 180° and present a fresh face of the body cover, target insert, and foam body for which to receive arrows. Although the foam body 12 is not the primary aiming point for arrows during use, it is to be understood that stray, misfired, or inaccurate arrow shots may strike the foam body. As such, the foam body is preferably constructed of a foam material having a density heavy enough, for example six lbs/cu/ft polyurethane foam, to withstand numerous strikes by arrows without being torn apart or disintegrated.

In accordance with the present invention, the target insert 42 has a transverse or vertical cross section which may be substantially circular (FIG. 1) or substantially oval (FIG. 6) and is sized so as to be received within and substantially fill the insert receiving recess in the foam body (FIGS. 4 and 6).

In accordance with the embodiment represented in FIG. 7 of the drawings, the overlapping and interfitting flanges 34 and 36 of the front and rear body sections 18 and 20 respectively include horizontal male and female dovetail elements 170 and 172 which provide for alignment of the flanges 34 and 36 with respect to one another and for releasably securing the flanges together and thereby releasably securing the front and rear body sections 18 and 20 together. Further, flanges 34 and 36 include vertically aligned openings which serve as drain holes 174 to provide for the drainage of any moisture collected in the recess 26.

In accordance with the embodiment shown in FIGS. 3 and 6 of the drawings, flanges 94 and 112 of front and rear body sections 72 and 74 contain vertically aligned openings for forming drain holes or conduits 174 for draining moisture which collects in the recess 118.

With reference again to FIG. 7 of the drawings, a target insert 180 adapted for use with broad head arrows is constructed of a substantially cylindrical elongate section of polyurethane foam 182 having embedded therein an elongate, rectangular, ethafoam core 184. In accordance with the preferred embodiment, the polyurethane foam 182 is six or less lbs/cu/ft polyurethane while the ethafoam block 184 is constructed of six to nine lbs/cu/ft ethafoam or a plurality of two or less lbs/cu/ft ethafoam sheets laminated together with screen or mesh between the sheets. In accordance with the preferred embodiment, the target insert 180 includes an elongate rectangular recess 186 located along the center line of the bottom of the insert and adapted for receiving the foam block 52. It is to be understood that if the foam block 52 is not utilized, and as such is not present in the archery target, the target insert 180 may have a substantially circular or substantially oval cross section adapted to be received within the recess 26 and also substantially fill the recess.

The target inserts 42 and 160 are somewhat flexible and thereby deform when placed within the insert receiving recess 26 and accommodate the foam block 52. Thus, it is not necessary to provide an elongate rectangular recess in the base of either of the target inserts 42 or 160 to accommodate the rectangular block 52. Inasmuch, as the target insert 180 is formed of a foam material which is semi-rigid, it is preferred to provide the elongate rectangular recess 186 in the base of the insert 180 and to remove and replace insert 180 by disassembling and assembling foam body 12 to eliminate the need to apply excessive pressure and force so as to deform the target insert 180 to fit within the recess 26 and accommodate the foam block 52. The ethafoam core 184 of the target insert 180 is oriented vertically in the same fashion as the central core 140 of the target insert 42. As such, the ethafoam core 184 provides for absorbing the impact and stopping the penetration of arrows through the insert 180. Since the target insert 180 is symmetrical with respect to the central core 184, it is adapted to be fired at from either side of the archery target or, if the archery target is only fired at from one side, to be removed from the target and rotated to provide a fresh side of the insert for target practice when one side has become worn, thus doubling the effective service life of the insert 180. Although the target insert 180 is especially adapted for use with broad head arrows, it may also be used with field point or target head arrows.

In accordance with another aspect of the present invention, a three-dimensional life-size game animal-simulating archery target system for use with both broad head and field point arrows includes at least one foam animal body and at least two target inserts, one especially adapted for use with broad head arrows and the other especially adapted for use with field point or target point arrows. Additionally, such a system includes at least one body cover, at least two elongate metal stakes, and an elongate ethafoam block for placement in between the target insert and foam body recess for preventing penetration of arrows through the archery target. Such an archery target system provides the user with the ability to carry out archery target practice and hunting preparation using a life-size game animal-simulating archery target. By placing the target insert adapted for use with field point or target point arrows in the archery target the user can fire field point or target head arrows at the target and then, by replacing the target insert with a target insert adapted for use with broad head arrows, the user can fire broad head arrows at the archery target. Thus, a user can use field point or target head arrows to practice and then, once achieving confidence with the field point and target head arrows, can switch to using broad head arrows and get a true simulation of arrow action in the field using the three-dimensional archery target system of the present invention.

The primary aiming point for the archery target of the present invention is the central area of the target insert. Thus, the central area of the target insert is to correspond to a kill area, vital area, or vital portions of the game animal represented by the foam body of the archery target. Hence, it is contemplated that the target insert receiving recess in the foam body may be located in slightly different areas of the foam body depending on the particular game animal and posture of the game animal depicted by the foam body.

Some of the advantages provided by the three-dimensional animal-simulating archery target of the present invention include ease of removal of arrows from the target insert, removable and replaceable, relatively inexpensive target inserts and body covers, target inserts can be constructed with either circular or oval transverse cross sections to adapt to different foam bodies representing different game animals, relatively easy to assemble and disassemble, lightweight, provides a life-like game animal appearance, and, as such, improves hunting preparation and increases the enjoyment of archery target practice, is structurally sound when assembled and will withstand extended use without coming apart, disintegrating, or requiring repair, has an extended service life due to the incorporation of replaceable target inserts and body covers, is made of a rugged construction which will withstand numerous assemblies, disassemblies and transportation of the target from one location to another, the replaceable target inserts and body covers are relatively inexpensive components and, as such, provide for a reduced cost of operating and maintaining the archery target.

It is contemplated that the body cover may be constructed of molded foam, such as polyurethane, having a density of two to six lbs/cu/ft, fabric, such as burlap, or cardboard.

With reference again to FIG. 5 of the drawings, the target insert 42 is produced using a cylindrical jig having a circular or oval cross section depending on the desired cross section of the target insert. For example, a cylindrical jig having a circular cross section can be a cylindrical barrel or drum having an inner diameter slightly less than the desired outer diameter of the finished target insert. Next, a heavy duty plastic bag is inserted in the cylindrical jig with a portion of the bag extending beyond the upper edge of the jig and being folded over the top edge so as to provide easy access to the interior of the bag. Then, eight sheets of twenty ounce burlap are folded over a cylindrical rod or dowel along their midsection and hung down into the jig along a plane bisecting the center of the jig. With the dowel resting on the top edge of the jig, the sheets extend from the top to the bottom of the jig.

Following placement of the burlap sheets, high grade cotton molt is stuffed down along the sides of the sheets and packed tightly so as to fill the space between the sides of the sheets and the plastic bag. Once the bag has been packed with cotton packing, the dowel is removed from the sheets and the top edges of the plastic bag are brought over themselves and secured with transparent packing tape so as to form an integral cylindrical item made up of the stacked sheets, cotton packing, and plastic bag serving as a moisture barrier.

Next, the cylindrical item is wrapped tightly with six layers of nylon netting wrapped around the long dimension of the item and, thereby, covering the ends. Then it is wrapped tightly with twenty or more layers of nylon netting around the sides of the item so as to form concentric circles with the longitudinal axis of the target insert. After being wrapped with the nylon netting, the item is inserted into a first burlap sack end first so that the burlap sack tends to secure the nylon netting around the item. Then the item is inserted end first into another ten ounce burlap sack so the target insert has two layers of burlap serving as an outer cover.

The insert is completed by securing the top edges of the burlap sack to the interior components of the target by stapling the burlap with staples which extend through the burlap layers and into the plastic bag and cotton packing. Alternatively, the burlap bags may have their top ends secured by use of hog rings or by being sewn shut.

Thus, it will be appreciated as a result of the present invention, a highly effective, three-dimensional, animal-simulating archery target having a removable target insert in the primary aiming point of the target is provided by which the principal objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only, not limiting, and that the true spirit and scope of the present invention be determined by reference to the appended claims.

What is claimed as invention is:

1. A three-dimensional animal-simulating archery target comprising:

a foam animal body shaped in the form of an animal having at least two legs, a head, and front and rear shoulders so as to simulate an animal at least when viewed from the side, and having a target insert receiving recess located in the back of the animal between the front and rear shoulders, a substantially cylindrical, removable arrow receiving target insert adapted to be received in and substantially fill said target insert receiving recess and, a removable arrow penetrating body cover adapted for placement over said target insert and providing a uniform appearance to the exterior surface of the foam animal body, whereby said target insert and body cover are located in the primary aiming point and the intended target for arrows during use of the archery target so that during extended use the foam animal body remains intact while the target insert and body cover are damaged by repeated arrow strikes and replaced as needed.

2. The archery target as recited in claim 1 further comprising releasable securing means for securing said target insert in an operative position in said recess during use of said archery target and for allowing said target insert to be removed from said recess to provide for removal of said target insert.

3. The archery target as recited in claim 2 wherein said releasable securing means comprises at least two straps with one end of each of said straps being secured to said foam body at opposing ends of said recess and the other end of each of said straps being adapted for releasable coupling with each other.

4. The archery target as recited in claim 1 further comprising mounting means located at the base of each of said legs of said foam body for mounting said archery target in an upright position for use.

5. The archery target as recited in claim 4 wherein said mounting means comprises a section of pipe having one end molded into the base of a respective one of said legs and the other end adapted to telescopically receive an upstanding end of a stake.

6. The archery target as recited in claim 1 wherein said target insert comprises a substantially cylindrical elongate section of foam adapted for receiving broad head arrows.

7. The archery target as recited in claim 1 wherein said target insert comprises a substantially cylindrical elongate fabric covered item filled with packing material and adapted for receiving field point arrows.

8. The archery target as recited in claim 7 wherein said packing material comprises compressed cotton molt.

9. The archery target as recited in claim 7 wherein said packing material comprises fabric pieces.

10. The archery target as recited in claim 1 wherein said target insert comprises a substantially cylindrical elongate fabric covered item adapted to receive field point arrows and having a free floating central core formed by a plurality of stacked sheets of penetration resistant material, said sheets being oriented along a common plane and serving to absorb arrow impact without being penetrated, said central core being surrounded by compressed packing material disposed within a moisture barrier, said moisture barrier having a plurality of layers of mesh material wrapped thereround and said mesh material being covered by said fabric.

11. The archery target as recited in claim 10 wherein said fabric cover is burlap fabric, said central core is burlap sheets, said packing material is cotton molt, and said mesh material is nylon mesh.

12. The archery target as recited in claim 1 wherein said target insert has a substantially circular transverse cross section.

13. The archery target as recited in claim 1 wherein said target insert has a substantially oval transverse cross section.

14. The archery target as recited in claim 1 wherein said body cover is made of molded foam and dimensioned so as to fit within said recess and provide a continuous contour to the exterior of the animal.

15. The archery target as recited in claim 1 wherein the exterior of said foam body and said body cover are similarly textured to provide the animal with a uniform appearance.

16. The archery target as recited in claim 1 wherein said foam body is formed of molded front and rear body sections joined together in an area defining the base of said recess.

17. The archery target as recited in claim 16 wherein said recess includes front and rear cavities each provided in a respective one of said front and rear body sections.

18. The archery target as recited in claim 16 wherein said front and rear body sections have respective overlapping and interlocking flanges including horizontally oriented male and female dovetail elements which provide for securely joining said body sections while allowing for subsequent separation of said body sections.

19. The archery target as recited in claim 1 further comprising an elongate rectangular block of foam secured to the base of said recess for preventing the passage of arrows through said archery target between the target insert and said recess.

20. The archery target as recited in claim 1 wherein said body cover includes printed score rings located over the central area of said target insert.

21. The archery target as recited in claim 1 wherein said target insert comprises an elongate section of urethane foam having an ethafoam core and adapted for receiving arrows.

22. A three-dimensional animal-simulating archery target system adapted for use with both broad head and field point arrows comprising:

a foam animal body shaped in the form of a game animal having at least two legs, a head, and front and rear shoulders so as to simulate a game animal at least when viewed from the side and having a target insert receiving recess located in the back of the animal between the front and rear shoulders, and a plurality of removable, substantially cylindrical elongate target inserts, each said insert adapted to be received in and substantially fill said target insert receiving recess, and at least one of said target inserts being adapted for use with broad head arrows and at least one other of said target inserts being adapted for use with field point arrows, whereby said archery target system provides for target practice using broad head arrows and field point arrows by selecting a target insert adapted for use with the desired type of arrow, placing said selected target insert in an operative position in said foam animal body target insert receiving recess and removing and replacing the selected target insert with another selected target insert when it is desired to use a different type of arrow.

23. The archery target system as recited in claim 22 wherein said at least one of said target inserts comprises a substantially cylindrical elongate section of foam adapted for use with broad head arrows.

24. The archery target system as recited in claim 22 wherein said at least one other of said target inserts comprises a substantially cylindrical elongate fabric covered item filled with packing material and adapted for receiving field point arrows.

25. The archery target system as recited in claim 22 wherein said at least one other of said target inserts comprises a substantially cylindrical elongate fabric covered item having a free floating central core formed by a plurality of stacked sheets of penetration resistant material, said sheets being oriented along a common plane and serving to absorb arrow impact without being penetrated, said central core being surrounded by compressed packing material disposed within a moisture barrier, said moisture barrier having a plurality of layers of mesh material wrapped therearound, said mesh material being covered by said fabric, and said item being adapted to receive field point arrows.

26. The archery target system as recited in claim 25 wherein said fabric cover is burlap fabric, said central core is burlap sheets, said packing material is cotton molt, and said mesh material is nylon mesh.

27. The archery target system as recited in claim 22 further comprising at least one removable body cover adapted for placement over one of said target inserts located in an operative position in said target insert receiving recess of said foam animal body and providing a uniform appearance to the exterior surface of the animal.

* * * * *